US006151845A

United States Patent [19]

Lancaster

[11] Patent Number: 6,151,845

[45] Date of Patent: Nov. 28, 2000

[54] ROOF RIDGE ASSEMBLIES

[75] Inventor: John Edward Lancaster, Clitheroe, United Kingdom

[73] Assignee: Ultraframe (UK) Limited, Lancashire, United Kingdom

[21] Appl. No.: 09/396,623

[22] Filed: Sep. 15, 1999

Related U.S. Application Data

[62] Division of application No. 08/900,772, Jul. 25, 1997.

[51] Int. Cl.[7] ..... E04B 7/00

[52] U.S. Cl. ..... 52/198; 52/200; 52/57

[58] Field of Search ..... 52/198, 200, 57

[56] References Cited

U.S. PATENT DOCUMENTS 5,713,158 2/1998 Gibbs ..... 52/198

FOREIGN PATENT DOCUMENTS

| | | |
|---|---|---|
| 2 691 195 | 5/1992 | France . |
| 2 247 474A | 3/1992 | United Kingdom . |
| 2 266 545A | 11/1993 | United Kingdom . |
| 2 275 064A | 8/1994 | United Kingdom . |
| 2 275 948A | 9/1994 | United Kingdom . |
| 2 284 836A | 6/1995 | United Kingdom . |

*Primary Examiner*—Beth A. Stephan
*Assistant Examiner*—Dennis L. Dorsey
*Attorney, Agent, or Firm*—Quarles & Brady LLP; George E. Haas

[57] ABSTRACT

A ridge assembly for a conservatory roof comprises a ridge body (10) having a base (36), side walls (20) extending upwardly from the base, flanges (40) extending downwardly from the base and means (42) for receiving ridge capping support elements (150).

15 Claims, 7 Drawing Sheets

ROOF RIDGE ASSEMBLIES

The present application is a division of application Ser. No. 08/900,772 filed Jul. 25, 1997.

BACKGROUND OF THE INVENTION

This invention concerns roof ridge assemblies, especially for conservatories.

It is known to construct conservatory roofs from polycarbonate roofing panels supported between glazing bars. The glazing bars are supported and connected at one end to a ridge structure and at the other end are supported by and connected to an eaves structure. Such ridge structures comprise a pair of flanges which the glazing bars are supported on and connected to. A ridge capping is connected to the ridge structure and provides cover for the ridge structure and the ends of both glazing bars and roofing panels. The ridge capping comprises two downwardly extending flaps or wings which overlie the ridge structure and the ends of the glazing bars and roofing panels to provide such cover. The wings of the ridge capping are kept spaced apart from the roofing panels so as to define a passageway therebetween in order to allow ventilation of the ridge structure and consequently the interior of the conservatory.

Manufacturers are continually seeking to reduce the time taken to assemble such conservatories since reduction in assembly time results in a saving of costs as well as to improve resistance to rain ingress and ventilation facilities.

SUMMARY OF THE INVENTION

An object of this invention is to provide an improved conservatory roof ridge assembly.

According to this invention there is provided a ridge assembly for a roof comprising a ridge body having a base, side walls extending upwardly from the base and flanges extending outwardly and downwardly from the base, wherein the ridge body has one or more of the following further features:

1. means for receiving ridge capping support elements;
2. the side walls are stepped to provide locations for glazing panel ends and/or glazing bar ends;
3. the side walls have locations for receiving rain baffle elements;
4. ends of the flanges are adapted to retain undercladding;
5. ends of the flanges are adapted to receive reinforcing cross bracing.

The means for receiving ridge capping support elements are preferably internal projections on which the support elements are mountable. The elements are preferably by being either slidable thereonto for positioning or may be snap-fitted onto the projections. In one preferred embodiment the ridge capping support elements are box sections with lateral extensions from top edges thereof on which the ridge capping sits. Additional means for fixing the ridge capping down may be required for this embodiment. Such additional fixing means preferably comprises a bolt with a head releasably engageable with the underside of the ridge capping and a stem fixable through the ridge body, possibly by a nut or the like but more preferably by a wedging action. For example, a wedge element may be slidable in a part of the ridge body to engage the stem of the bolt and hold same against axial movement.

In another preferred embodiment, the ridge capping support elements have a central section and upwardly and outwardly directed wings with downwardly directed edges.

The ridge capping preferably has upwardly directed internal projections which can fit under the downwardly directed edges of the wings of the support elements to hold the capping in place.

The ridge cap support elements are preferably height adjustable to accommodate different depths of glazing bar. Preferably the support elements comprise two parts that are relatively adjustable, one part capable of fitting onto the ridge body and the other part capable of being fitted to the first part to provide support elements at different relative heights for the ridge cap.

In one preferred form, said other part has a body with a series of annular grooves on its outer surface and said one part has means for selectively engaging one of said grooves to retain said other part. Said one part preferably has an aperture therethrough into which the other part can be fitted in one orientation and then rotated to another orientation, preferably at 90 to the first, whereby one of said grooves is engaged in the first part to retain said other part.

The ridge body preferably has on opposite sides channels to receive ends of glazing panels. These channels may further include locations for retention of rain baffles which are provided to inhibit passage of rain about glazing panel ends into the ridge assembly.

Ends of glazing bars preferably lie on and are securable to the outwardly extending flanges of the ridge body. Ends of retaining undercladding. The preferred undercladding has a base and returned sides which locate on said steps. The undercladding preferably has at least one location for ventilation means, preferably of the hit or miss type, i.e. where a series of apertures in the undercladding can be opened or closed by a similarly apertured slidable strip. Such ventilation means may be provided in any one or more of the base of the undercladding or the returned sides thereof. In each case the undercladding will have a channel-like slot for receiving the slidable apertured strip.

Preferably on the underside of the flanges of the ridge body are formations for receiving ends of cross braces. Preferably the cross braces can be slid into desired positions.

BRIEF DESCRIPTION OF THE DRAWINGS

This invention will now be further described, by way of example only, with reference to the accompanying drawings, in which.

DETAILED DESCRIPTION OF THE INVENTION

Figures 1, 2:
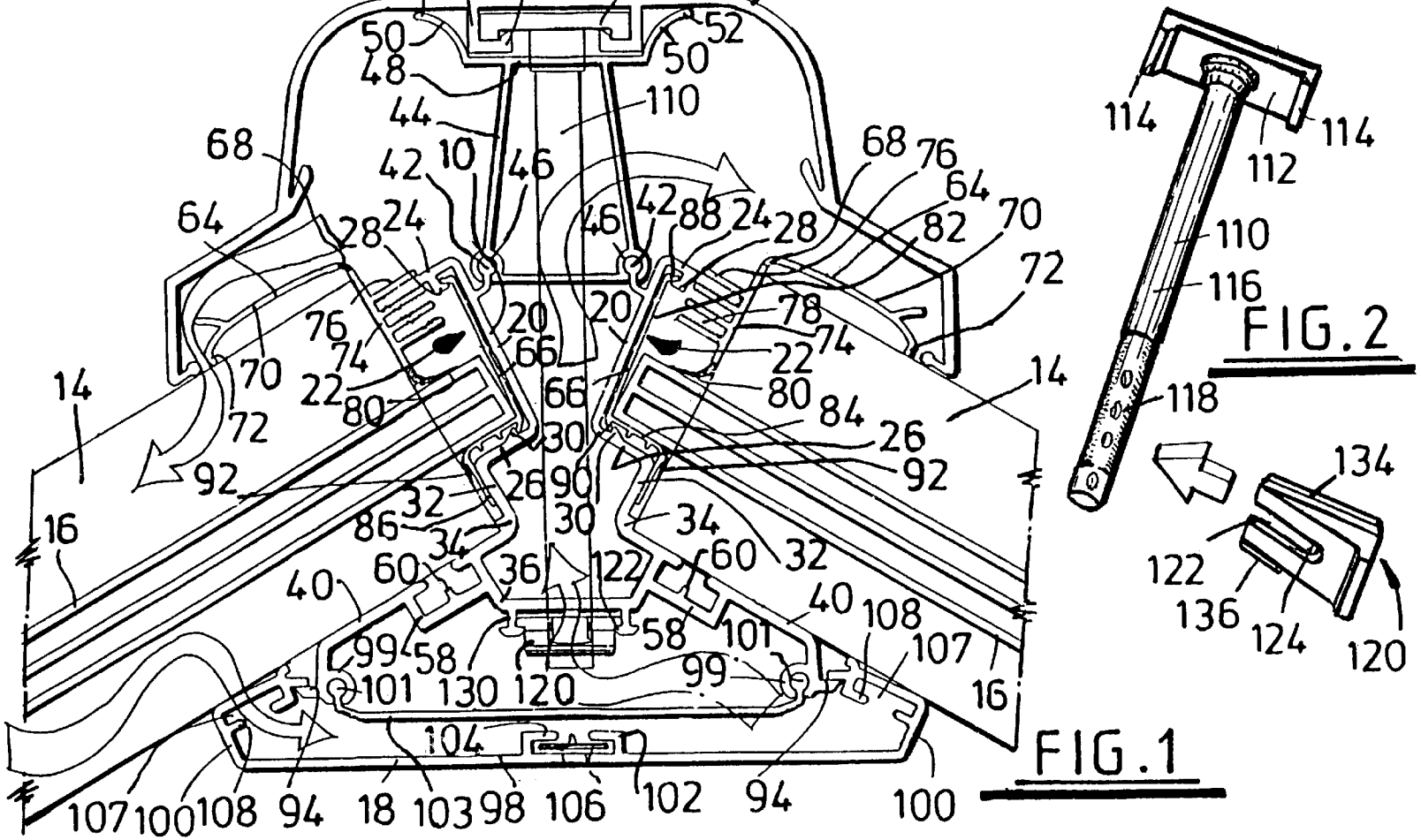
FIG. 1 is an end view first embodiment of a ridge assembly for a conservatory roof.
FIG. 2, shows components of the assembly of FIG. 1.

Referring to FIG. 1 of the accompanying drawings, a ridge assembly for a conservatory roof has a ridge body 10 formed as an aluminum extrusion. The ridge body 10 is generally slim and open-topped. The ridge body 10 is shaped to provide locations for attachment means for a ridge cap 12, glazing bars 14 and panels 16, and undercladding 18.

The ridge body provides at its upper part upwardly divergent sides 20 which form the bases of outwardly open channel sections 22 having top sides 24 and bottom sides 26. Within the channel 22 the top side 24 has a longitudinal returned rib 28 and the bottom side 26 has a longitudinal rib 30.

From the outer ends of the bottom channel sides 26 the ridge body walls have downwardly extending sections 32 which are stepped at 34. The sections 32 are joined by a base section 36. Where the walls are stepped at 34 there are sideways continuation flanges 40.

Near the top of the divergent sides 20 of the ridge body 10 on their inward facing surfaces are projections 42 for receiving spaced apart box section carriages 44. The slots 46 whereby they can be slid onto the projections 42 and into position on the ridge body. The carriages 44 have a top 48 that is extended to both sides 50 laterally and over a final part 52 upwardly to provide a support for a ridge top capping 12.

The glazing bars 14 comprise an aluminum glazing beam with upper and lower cappings, each of which has co-extended gaskets along its edges that abut against the glazing panels 16. The glazing bars 14 are fixed onto the flaps 40 and abut against the ridge body. Longitudinal channels 58 are provided in the flaps 40 with an upstanding internal rib 60 on their bottom surface. The channels 58 are to receive heads of securing bolts (not shown) which fix the glazing bars 14 in place. The channels allow the bolts to be slid to the appropriate positions whilst holding them captive.

The glazing panels 16 extend into the channel sections 22 and top and bottom rain baffles 64, 66 respectively are provided. The top rain baffle 64 is a generally L shaped plastics extrusion with a resilient flexible elbow 68. One limb 70 of the baffle 64 is slightly arcuate terminating in a foot 72 that rests on top of the glazing beams 54. The other limb 74 has a series of projections 76 extending normally thereto, which provide a series of slots 78 with serrated side walls any of which can be push fitted onto the top side 24 of the channel section, which has serrated upper and lower surfaces for grip, depending on the thickness of the glazing panels. At its bottom end the other limb 74 has a co-extended gasket strip 80 that provides a seal between the glazing panels and the baffle.

The bottom rain baffle 66 is a plastics extrusion and has three webs 82, 84 and 86 generally at right angles to each, whereby the first and third webs are substantially parallel, the first web extending upwards from one side of the second web 84 and the third web extending downwards from the other side of the second web.

The first web 82 of the baffle 66 has along its top edge a lip 88 and a similar lip 90 on its bottom edge beyond its junction with the second web 84. These lips 88 and 90 are provided to retain the baffle 66 in the channel section 22, the lips 88 and 90 being retained respectively behind the ribs 28 and 30. The baffle 66 thus snap-fits into the channel section 22.

On the outer face of the third web 86, just below its junction with the second web 84 is a co-extended gasket strip 92 which abuts against the ends of the glazing bars below the glazing panels 16 which actually sit on the second web 84 of the rain baffle 66.

The flanges 40, extending from the ridge body 10 have their ends turned first downwards and then outwards to provide ledges 94. The ledges 94 are for retaining undercladding 18 in position below the ridge body. The undercladding 18 has a generally flat base 98 and returned ends 100 edges of which fit over the ledges 94. The undercladding 18 has three positions for fitting of hit and miss ventilators.

Centrally of the base 18 is a channel 102 with lipped 98 along the line of the channel 102 and the strip 104 each have a series of spaced apertures therethrough, whereby the strip 104 can be slid along the channel to bring the apertures of the channel and the strip into and out of register depending on the ventilation requirements.

The returned ends 100 of the undercladding 96 have internally of the undercladding channels 106 with lipped edges 108 for retaining apertured strips (not shown). Along the lines of the channels 106, the undercladding has spaced apertures (not shown). The apertured strips are slidable in the channels 106 to provide further hit or miss ventilations, wherein the apertures in the channels 106 are opened or closed by the strips being slid along to bring their respective apertures into or out of register.

The ventilation paths through the ridge assembly are indicated by arrows. As will be appreciated the base section 36 of the ridge body 10 is also apertured at spaced intervals.

In this embodiment the ridge capping 12 is secured to the ridge assembly by captive bolts 110. The bolts 110 have a rectangular head 112 (see FIG. 2) with lips 114 on its shorter sides. The bolts have stem 116 which has a lower part 118 serrated on opposite sides for receiving a wedge shaped retaining element 120 with a generally U-shaped slot 122 therein having in the base of U-slot a web 124 that is engageable in the serration 118 of the stem 116 of a bolt 110.

On the underside of the capping 12 is a channel formation 126 having returned edges 128. The channel 126 is wide enough to receive the head of a bolt with its longer sides parallel lips 114 of the head of the bolt are retained by the returned edges 128 of the channel 126. At its other end the bolt stem passes through an aperture in the base 36 of the ridge body 10. Extending below the base 36 are a pair of spaced parallel flanges 130 with inwardly directed lips 132 to provide a slot for receiving the wedge shaped element 120. The element 120 has on its sides retaining ribs 134, 136 (FIG. 2) one of which extends along the full length of the element, and the other being shorter, whereby the element can be manoeuvered into the slot. Once there, the element is slid along to engage and retain the stem of the bolt 110.

It will be noted that the ridge capping 12 top surface has various projections 140 generally designated therefrom. These projections are for receiving and retaining decorative ridge elements.

Figure 3:
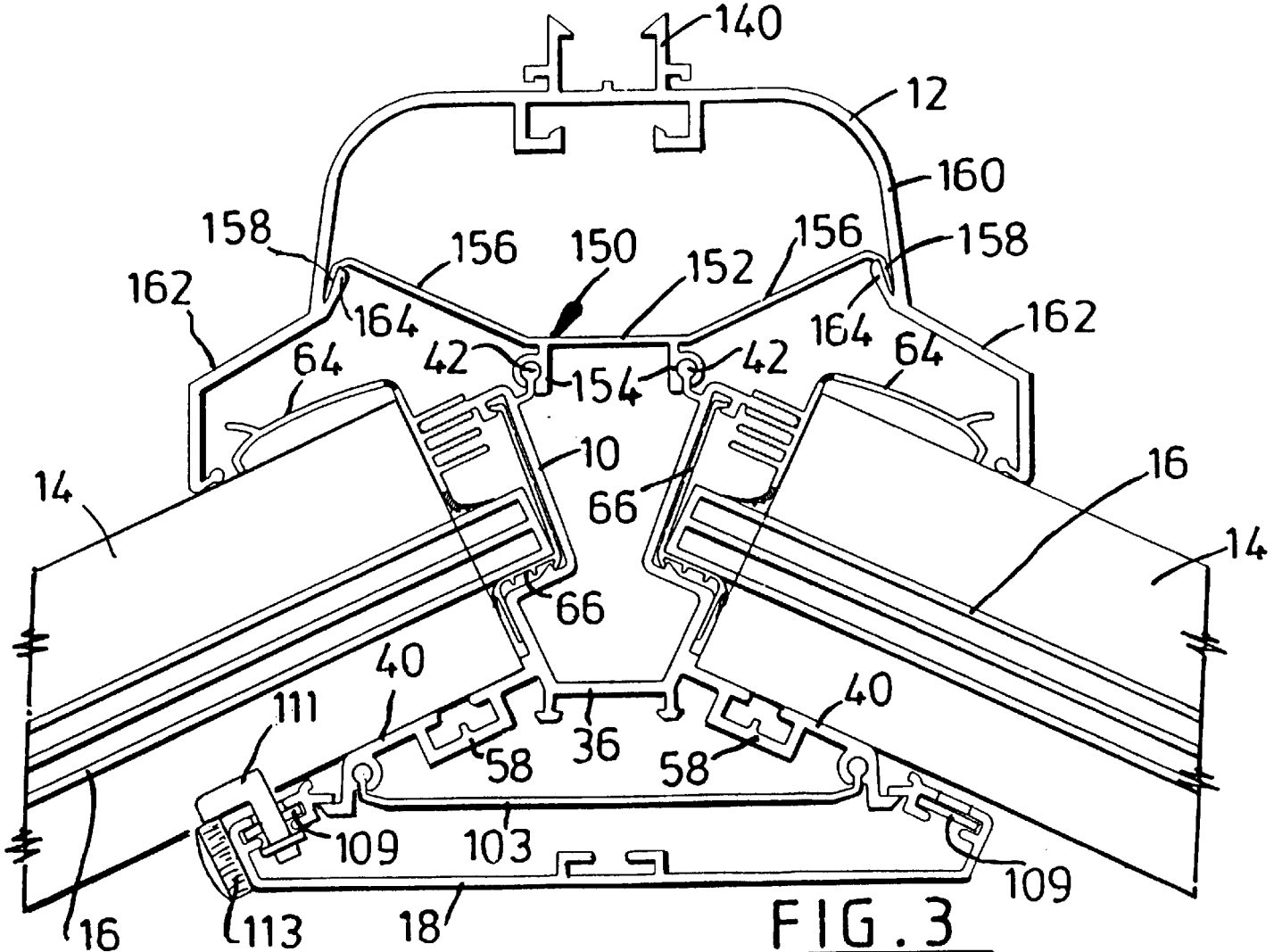
FIG. 3 is an end view of a second embodiment of a ridge assembly for a conservatory roof.
Figure 4:
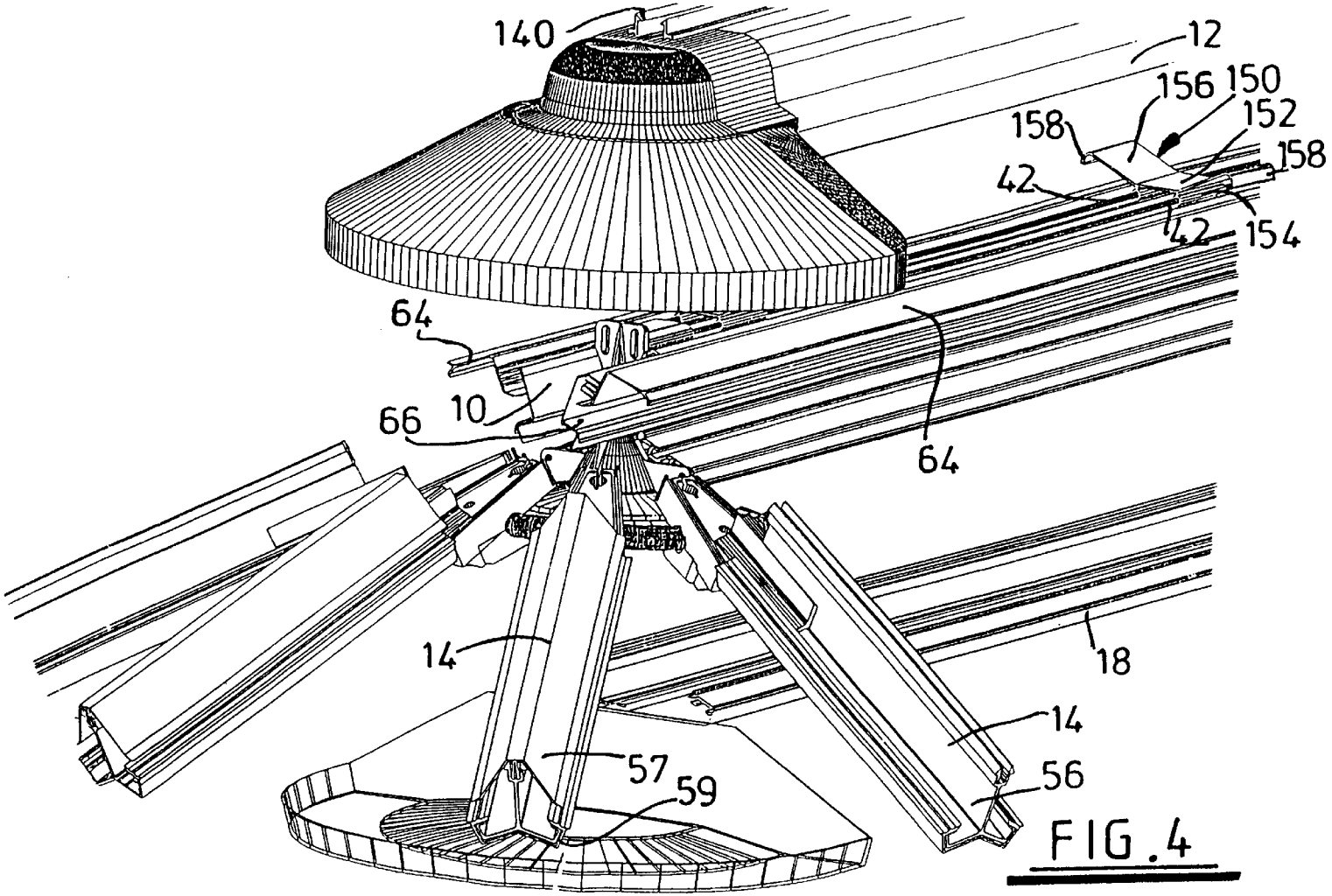
FIG. 4 is a perspective view of the embodiment of FIG. 3.

Turning to FIGS. 3 and 4 of the accompanying drawings, there is shown a variation of the embodiment of FIG. 1. Like parts have been given the same reference numerals and will not be described in any detail. The main difference between the respective embodiments is the means of securing the ridge capping 12. The ridge capping has been designed so that it can be used with either securing method.

In the embodiment of FIGS. 3 and 4, instead of the projections 42 on the inward faces of the ridge body receiving carriages 44, they receive retaining elements 150. The elements 150 have a central section 152 with suitably slotted downwards projections 154 at each end thereof for sliding onto the projection 42. Extending upwardly and outwardly downturned edges 158. The retaining elements 150 are generally provided at intervals along the ridge body 10.

The ridge capping 12 comprises a hood 160 with flared sides 162 extending therefrom. Internally of the capping where the sides and the hood meet, are upwardly directed lips 164 to provide slots for receiving the edges 158 of the retaining elements 150 to retain the capping on the elements. The capping 12 will usually be of plastics material and the elements 150 of metal, such as aluminum, so that the capping can be snap fitted on to the elements 150.

Figure 5:
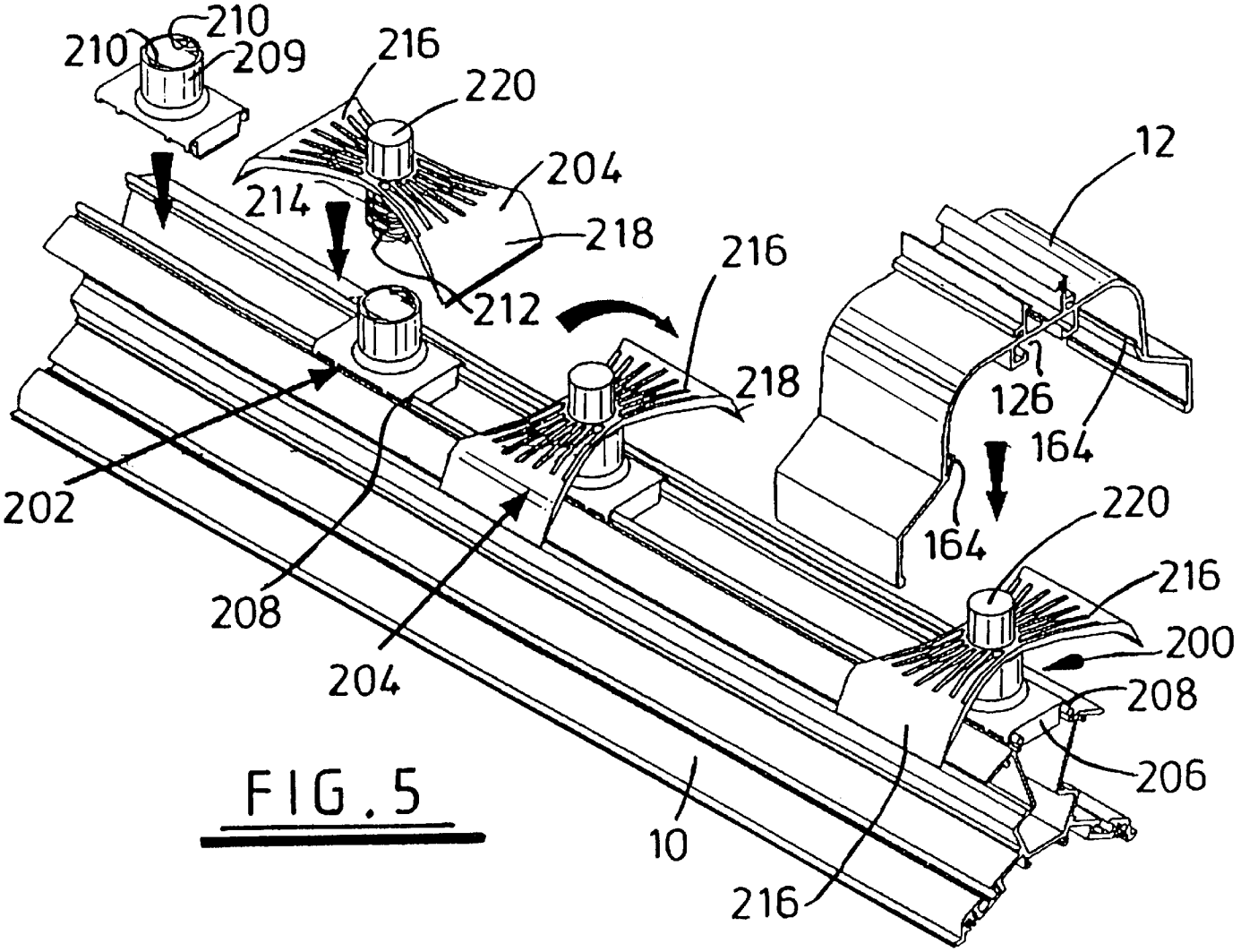
FIG. 5 is a perspective view of a third embodiment of a ridge assembly for a conservatory roof.
Figure 6:
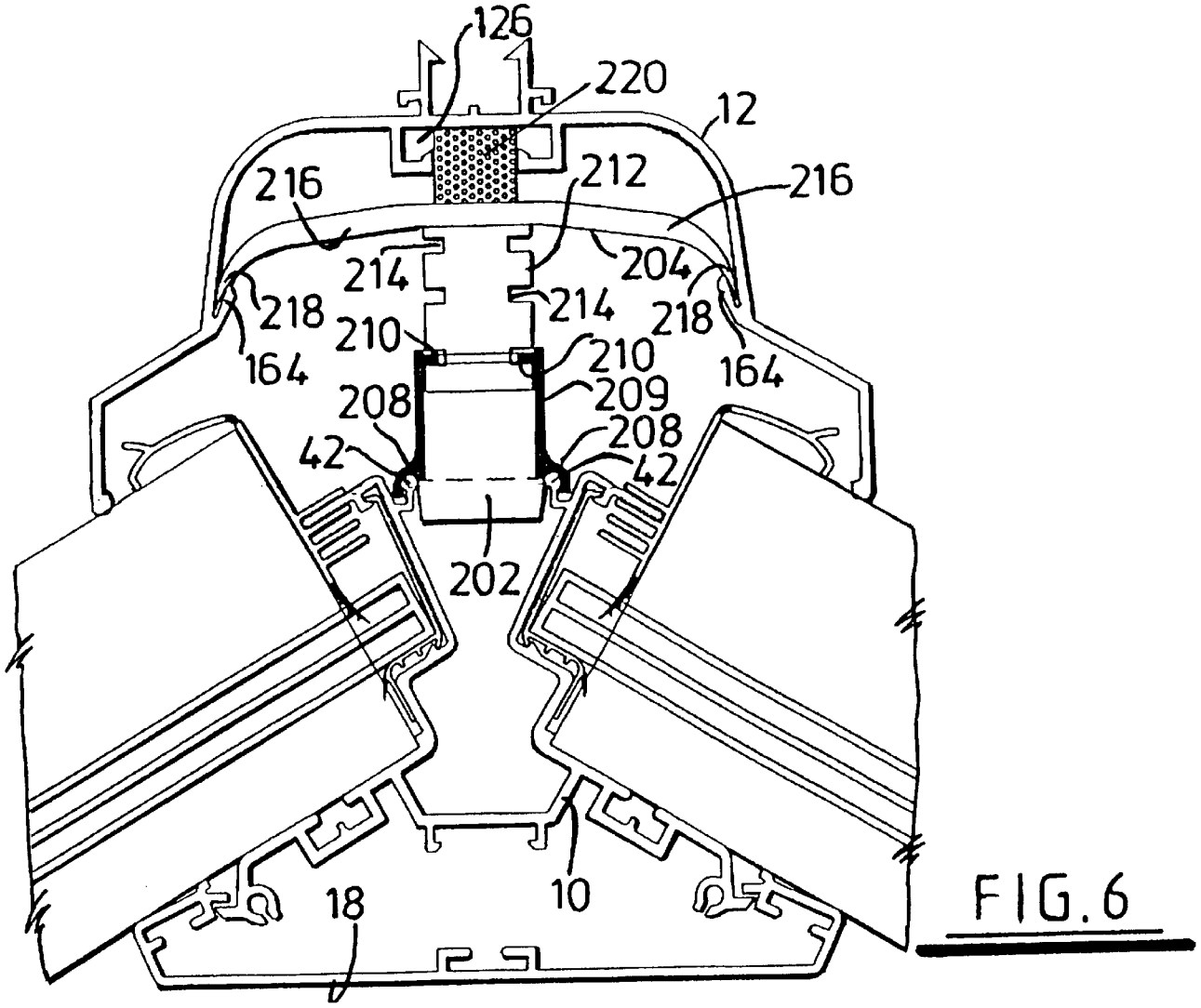
FIG. 6 and 7 is an end view of a fourth embodiment of a ridge assembly for a conservatory roof.

In FIGS. 5 and 6 the ridge assembly shown makes provision for different depths of glazing bar and hence different thicknesses of glazing panels. The same ridge body 10 and ridge cap 12 as shown in the other illustrated embodiments are used in this embodiment with the same connection of glazing bars and glazing panels but the means of affixing the ridge cap 12 to the ridge body 10 is different and will be described in more detail. The ridge body 10 has upwardly directed projections 42 and onto these carriages 200 are fitted either by sliding them along the projections or by a snap-fit onto the projections. The carriages 200 are in two parts 202 and 204 that interfit. The first part 202 has a base 206 with a pair of channels 208 on its underside spaced apart and shaped so as to be capable of being slid onto or snap-fit onto the projections 42 of the ridge body. Centrally of the base is a tubular upstand 209 having in its top a pair of segmental lips 210 in order to provide a top opening having one pair of parallel sides.

The second part 204 of a carriage has a body 212 with three annular grooves 214 one pair of opposed sides whereof are flattened so that the body 212 can slot into the upstand 208 of the first carriage part in one orientation but when rotated through 90 the lips 210 engage in the grooves 214 between the flattened portions to locate the second carriage part in position.

Extending laterally from opposite sides of the body 212 and parallel to the flattened sides of the grooves 214 are wings 216 with downturned edges 218. The edges 218 locate in the upwardly directed lips 164 of the ridge cap 12.

Atop the second part 204 of the carriage is a foam block 220 which fits the channel 126 on the underside of the ridge cap 12 to locate and cushion the ridge cap.

To fit the ridge cap 12 to the ridge body 10, a number of carriages 200 are fitted onto the ridge body at intervals, the first parts 202 either being snapped or slid into place. Then the second parts 204 are fitted into the first parts to a depth corresponding to the depth of the glazing bar system making up the roof i.e. until the appropriate groove 214 is aligned with the lips 210 of the first part of the carriage, when the second part 204 is rotated through 90 to engage the lips 210 in the groove 214 in order to locate the second part of the carriage in the first part. Ridge cap 12 then is pushed down onto the carriages until the lips 164 of the cap 12 locate behind the ends of the wings 216. The ridge cap 12 being of plastics material can resiliently deform to achieve that.

Figure 7:
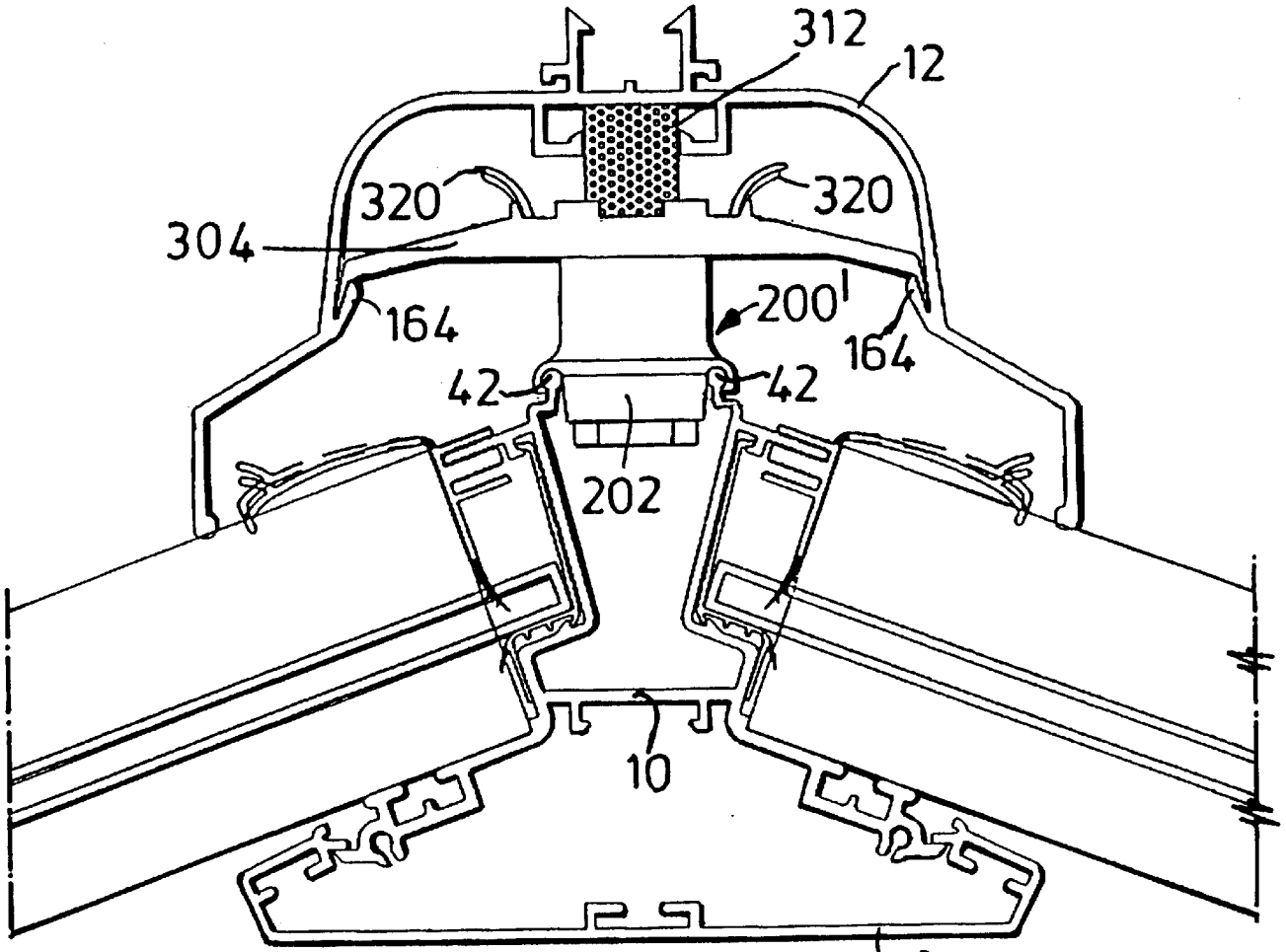
Figures 8, 9:
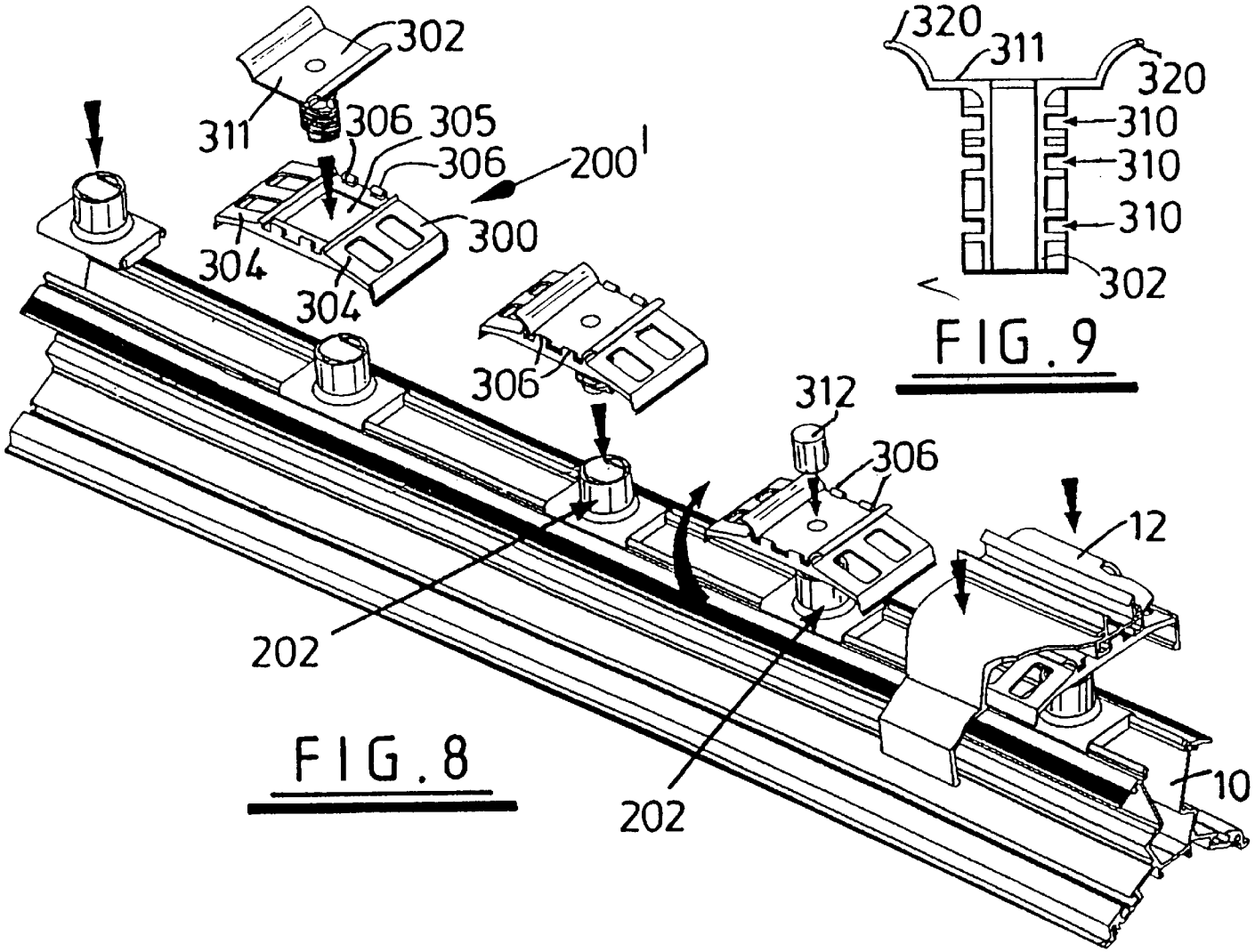
FIG. 8 is a perspective view of the embodiment of FIG. 7.
FIG. 9 shows a component of the embodiment of FIGS. 7 and 8.

FIGS. 7 to 9 of the corresponding drawings show a second parts of carriages 200' are themselves in two parts that snap together, one part 300 providing the wings for attachment of the ridge cap and the other part 302 providing annular grooves for height adjustment of the carriages.

Part 300 has a pair of wings 304 either side of a central section having an aperture 305 therethrough. On opposite sides of the aperture are pairs of lugs 306. The part 302 has a tubular body 308 with three annular grooves 310 formed on its outside with opposite sides flattened for it to fit into bottom carriage part 202 in one orientation and to be retained in said part by being rotated through 90 as in the embodiment of FIGS. 5 and 6. Atop the tubular body is a generally flat plate 311 which is sized to fit over the aperture 305 with its edges snap fitting under the lugs 306. A foam rubber retention and cushioning block 312 may be fitted on top of the plate 310.

The carriages 200' are otherwise used in the same way as the carriages 200 of FIGS. 5 and 6 of the drawings.

The carriage 200' can also be used without the wing part 300 in much the same way as the carriages 44 of FIGS. 1 and 2 of the drawings. The plate 311 has an upwardly and outwardly curving edge formations 320 that can act as ridge capping supports, the ridge capping being secured in place by 6means of captive bolts, for example, as in the embodiment of FIGS. 1 and 2. The foam block 312 would be omitted from that foam. Thus, the carriages 200' can be used in two different ways to secure a ridge capping by including or omitting the wing part 300.

What is claimed is:

1. A ridge assembly for a roof comprising a ridge body having a base, side walls extending upwardly from the base and flanges extending outwardly and downwardly from the base, ridge capping support elements received on the ridge body, and a ridge capping supported by the ridge capping support elements, wherein the ridge capping support elements have a central section and outwardly directed wings with downwardly directed edges and the ridge capping has upwardly directed internal projections which fit under the downwardly directed edges of the wings of the support elements to hold the capping in place.

2. An assembly as claimed in claim 1, wherein the flanges of the ridge body have undersides having formations thereon for receiving ends of cross braces.

3. An assembly as claimed in claim 1, wherein the ridge body has internal projections on which the support elements are mounted.

4. An assembly as claimed in claim 1, wherein the ridge capping support elements are height adjustable to accommodate different depths of a glazing bar.

5. An assembly as claimed in claim 4, wherein the support elements comprise two parts that are relatively adjustable, one part being fitted onto the ridge body and the other part being fitted to the first part to provide support elements at different relative heights for the ridge cap.

6. An assembly as claimed in claim 5, wherein said other part has a body with a series of annular grooves on its outer surface and said one part has means for selectively engaging one of said grooves to retain said other part.

7. An assembly as claimed in claim 6, wherein said one part has an aperture therethrough into which the other part can be fitted in one orientation and then rotated to another orientation, whereby one of said grooves is engaged in the first part to retain said other part.

8. An assembly as claimed in claim 1, wherein the side walls of the ridge body are stepped to provide locations for glazing panel ends and/or glazing bar ends.

9. An assembly as claimed in claim 8, wherein the ridge body has an opposite sides channels to receive ends of glazing panels.

10. An assembly as claimed in claim 9, wherein said channels include locations for retention of rain baffles to inhibit passage of rain about glazing panel ends into the ridge assembly.

11. An assembly as claimed in claim 1, wherein ends of the flanges of the ridge body are adapted to provide locations for retaining undercladding.

12. An assembly as claimed in claim 11, wherein said ends of the flanges are stepped to provide locations for retaining undercladding.

13. An assembly as claimed in claim 12, further comprising an undercladding that has a base and returned sides which locate on said steps.

14. An assembly as claimed in claim 11, further comprising an undercladding that has ventilation means.

15. An assembly as claimed in claim 14, wherein the ventilation means comprises a series of apertures in the undercladding that are opened and closed by a similarly apertured slidable strip.

* * * * *